United States Patent [19]

Takeda et al.

[11] Patent Number: 4,513,720

[45] Date of Patent: Apr. 30, 1985

[54] FUEL INJECTION DEVICE FOR MOTOR VEHICLE

[75] Inventors: Keisou Takeda, Susono; Toshiyuki Hirata, Toyota, both of Japan

[73] Assignee: Toyota Jidosha Kabushiki Kaisha, Japan

[21] Appl. No.: 515,668

[22] Filed: Jul. 20, 1983

[30] Foreign Application Priority Data

Dec. 14, 1982 [JP] Japan ..... 57-188884[U]

[51] Int. Cl.[3] ..... F02M 61/14

[52] U.S. Cl. ..... 123/470; 123/545

[58] Field of Search ..... 123/470, 471, 468, 469, 123/472, 478, 545

[56] References Cited

U.S. PATENT DOCUMENTS

| | | | |
|---|---|---|---|
| 3,762,385 | 10/1973 | Hollnagel | 123/545 |
| 4,212,277 | 7/1980 | Melotti | 123/472 |
| 4,243,003 | 1/1981 | Knapp | 123/470 |
| 4,351,305 | 9/1982 | Isogai et al. | 123/470 |
| 4,373,491 | 2/1983 | Knapp | 123/472 |
| 4,416,241 | 11/1983 | Knapp et al. | 123/470 |
| 4,467,771 | 8/1984 | Atago et al. | 123/472 |

FOREIGN PATENT DOCUMENTS

| | | | |
|---|---|---|---|
| 2928350 | 2/1981 | Fed. Rep. of Germany | 123/472 |
| 54-114642 | 9/1979 | Japan . | |
| 134221 | 10/1979 | Japan | 123/470 |
| 129256 | 8/1982 | Japan | 123/470 |
| 27827 | 2/1983 | Japan | 123/472 |

OTHER PUBLICATIONS

SAE Paper 790742, Ford's 1980 Central Fuel Injection System p. 5.

*Primary Examiner*—Magdalen Y. C. Moy

*Attorney, Agent, or Firm*—Parkhurst & Oliff

[57] ABSTRACT

A fuel injection apparatus for use in an internal combustion engine, which improves the fuel distribution performance by orienting the fuel injection valve in a position not corresponding to the center line of the throttle bore. The apparatus comprises a throttle body and a control means for directing the fuel injected by the fuel injection valve toward a downstream portion of the throttle valve.

15 Claims, 8 Drawing Figures

FUEL INJECTION DEVICE FOR MOTOR VEHICLE

BACKGROUND OF THE INVENTION

The present invention relates to a fuel injection device for an internal combustion engine, such as those typically used in a motor vehicle, and more particularly to a device by which the fuel-air mixture is uniformly distributed into each of the combustion chambers in an engine.

FIG. 1 shows a conventional fuel injection device in which the fuel injection valve 3 is vertically installed above the throttle valve 2, which is rotatably mounted in the throttle bore 4 of the throttle body 5. The throttle valve 2 rotates when the operator of the vehicle moves or depresses the accelerator. The fuel injection nozzle of the fuel injection valve 3 is oriented so that the fuel is directed toward the downstream area of throttle valve 2, which in FIG. 1 corresponds to the left side of the throttle bore 4. The fuel supply injected by valve 3 enters in the approximate form of a hollow circular cone which is injected into the opening defined by the outer periphery of the throttle valve 2 and the throttle bore 4. The center line of the fuel injection valve 3 coincides with the center line of the throttle body 5 and the center line of the throttle bore 4. Fuel is supplied to the fuel injection valve 3 of the fuel supply passage 6. If there is any excessive accumulation of fuel in the injection valve, it is returned to the fuel tank through the fuel return passage 7. The cavity 8 houses an electric connector which controls the fuel injection valve 3. The fuel supply passage 6 and the cavity 8 are contained in the supporting bar 9, which projects from the throttle body 5 into the throttle bore 4 and supports the fuel injection valve 3. The fuel return passage 7 is located in a second supporting bar 10, which projects into the throttle bore 4 in the opposite direction from the first supporting bar 9 and assists in supporting the fuel injection valve 3.

The fuel injected by the fuel injection valve 3 passes the throttle valve by one of two methods: it either hits the upstream side of the valve (right end of throttle valve 3 in FIG. 1) and then flows across the valve to the downstream side (left end of throttle valve 2 in FIG. 1), and into the manifold (not shown in drawings) or it is injected directly into the manifold area without contacting the throttle valve 2. This results in the injected fuel gathering on one side of the throttle bore 4, causing a non-uniform distribution of fuel into each cylinder of a multi-cylinder engine. It is generally preferred for the injected fuel to create a fuel cone injection angle $\theta$ which ranges somewhere between 60° to 90°.

This non-uniform distribution of fuel becomes more prevalent when the atmospheric temperature is low or there is a substantial difference in the shape of each intake manifold. This non-uniform fuel distribution results in lower engine output, rough engine idling and even more important, the presence of a transitional response (hesitation) of engine power dependent upon the opening angle of throttle valve 2.

SUMMARY OF THE INVENTION

The present invention was made in view of the above background and to overcome the above-discussed drawbacks. It is accordingly an object of this invention to provide an improved fuel injection device which uniformly distributes fuel into each cylinder of an engine.

To attain the above objects, a device according to the present invention comprises:

a throttle body having a throttle bore therein;

throttle valve means, rotatable in response to accelerator means, for controlling the amount of the fuel-air mixture supplied to the throttle bore;

a fuel injection valve mounted upstream of the throttle valve for injecting fuel into the downstream part of the throttle valve because its center line is oriented toward the downstream part of the throttle valve, resulting in uniform distribution of fuel to each cylinder.

BRIEF DESCRIPTION OF THE DRAWINGS

The above object, features and advantages of the present invention will become more apparent from reading the following description of the preferred embodiments taken in connection with the accompanying drawings wherein.

DETAILED DESCRIPTION OF THE PREFERRED EMBODIMENTS

The present invention is described in detail with reference to the accompanying drawings which illustrate different embodiments of the present invention.

Figure 2:
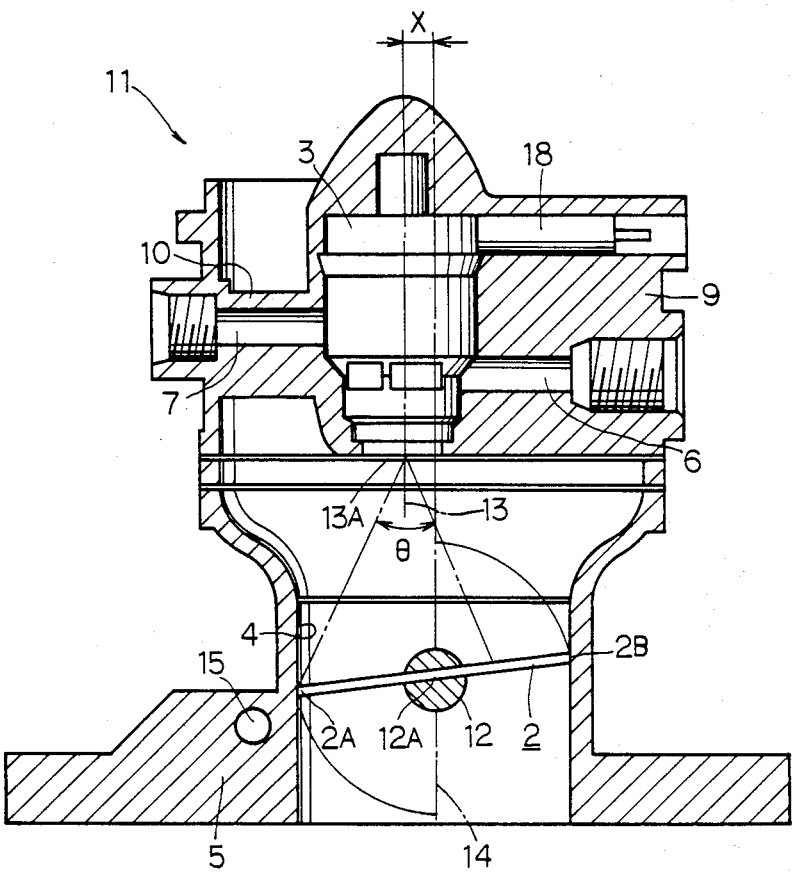
FIG. 2 is a cross-sectional view of an embodiment according to the present invention.

In reference to the drawings, corresponding reference characters have been used whenever possible to designate similar parts. FIG. 2 shows a cross-sectional view of the first embodiment according to the present invention.

The fuel injection device 11 includes a fuel injection valve 3 installed upstream of the throttle valve 2. The center line 13 of the fuel injection valve 3 is parallel to the center line 14 of the throttle bore 4, but it is offset by the distance "X" towards the downstream edge 2A of throttle valve 2. The downstream side of throttle valve 2 is defined as the area between the axis 12A of the throttle valve 2 and the downstream tip end 2A. This construction almost always permits the injected fuel to hit the downstream side of the throttle valve 2 independent of the opening angle of the throttle valve 2. The fuel injection angle $\theta$ is adjusted so that the injected fuel will fall primarily upon the downstream side of the throttle valve 2.

The fuel injection angle $\theta$ created by the fuel injection valve 3 is adjusted so that the outer limit of the fuel cone intersects the wall of the throttle bore at the closed valve position of the throttle valve 2 at the edge 2A.

In this embodiment, the size of each component is as follows:

| | |
|---|---|
| (1) Inside diameter of throttle bore 4: | 45 mm |
| (2) Vertical distance between the central axis 12A of throttle shaft 12 and the center point 13A of fuel injection: | 35 mm |
| (3) Offset distance of the fuel injection valve 3 to the center line of throttle bore 4: | 5 mm |
| (4) Fuel injection angle: | 50° |

In this embodiment, the center line 13 of the fuel injection angle $\theta$ is offset toward the downstream edge 2A of the throttle valve 2 in comparison to the center axis line 14 of throttle bore 4. This offset results in the injected fuel always flowing past the downstream edge 2A of the throttle valve 2 and never flowing past the upstream edge 2B of the throttle valve 2. Hence, a previously unobtainable steady fuel-air mixture is attained in the throttle bore 4.

As a result of this steady fuel-air supply, the ratio of fuel distributed to each cylinder of the engine does not change with the opening of the throttle valve 2. Therefore, the transitional response performance of the engine is improved over the transitional response performance of the conventional fuel injection device 1 as disclosed in FIG. 1. The improvement in the transitional response performance of the engine can be attributed to the following: The fuel contact area in the throttle valve 2 of the fuel injection device 11 is smaller than the fuel contact area on the throttle valve 2 of the fuel injection device 1 and the velocity of the fuel-air mixture near the throttle shaft 12 is greater in fuel injection device 11 than in fuel injection device 1. Because of these two afore-mentioned facts, the fuel is less likely to adhere to the top of the throttle valve because a lesser contact area is involved and a higher velocity of fuel occurs near the central portion of the throttle valve 2. This permits for the fuel to be more evenly distributed and facilitates atomization of the fuel. Therefore, the decreased flow of fuel across the throttle valve 2 increases the output performance of the engine by improving the distribution of fuel to each cylinder.

Figure 3:
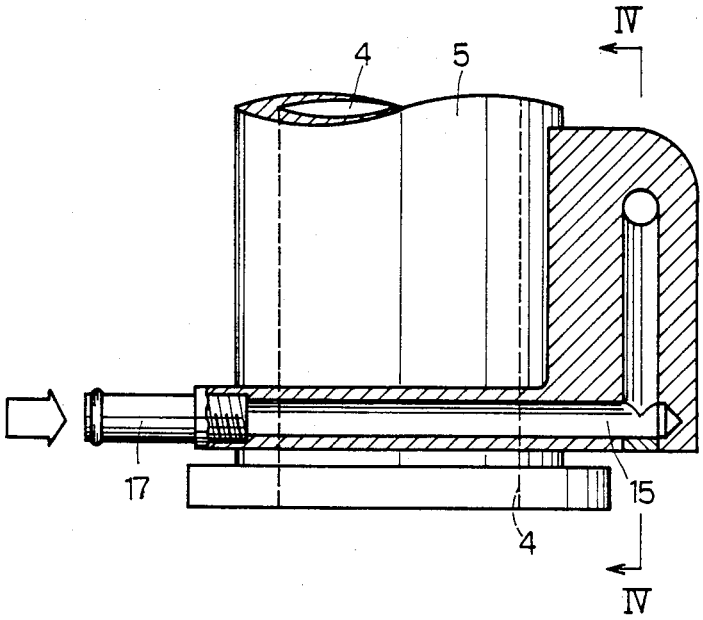
FIG. 3 is a cross-sectional view of a warm water passage embodied in FIG. 2.
Figure 4:
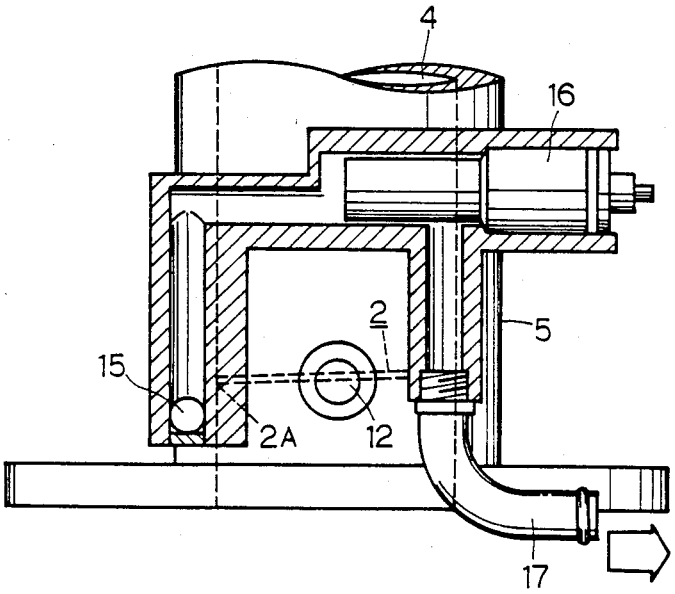
FIG. 4 is a cross-sectional view taken along line IV—IV of FIG. 3.

To further enhance the atomization of fuel, a warm water passage 15, as shown in FIG. 2, is placed in the throttle body 5. This warm water passage, which is more clearly shown in the cross-sectional views in FIGS. 3 and 4, is connected to the engine radiator by water passage 17. A thermo-wax 16 is provided between the warm water passage 15 and the engine cooling water passage 17 in order to increase the throttle valve opening at low engine operating temperatures. The warm water passage 25 partially encircles the throttle bore 4 and extends into an area corresponding to the downstream edge 2A of the fully closed throttle valve 2.

In this embodiment, fuel injected by fuel injection valve 3 and directed into an aperture defined between the downstream edge 2A of the throttle valve 2 and the throttle bore 4, is efficiently heated by warm radiator water passing through warm water passage 15, thereby improving the atomization of the injected fuel.

Figure 5:
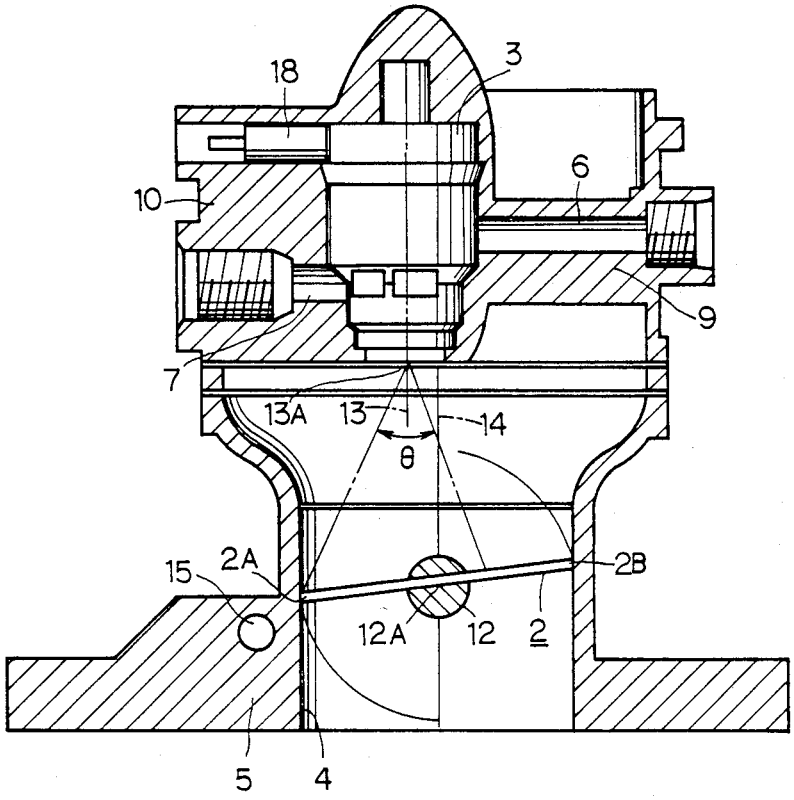
FIG. 5 is a cross-sectional view of another embodiment according to the present invention.

In the embodiment disclosed in FIG. 2, the fuel supply passage 6 and the electric wiring connector 18 are located vertically adjacent to each other in the first supporting bar 9. The fuel return passage 7 is contained in the second supporting bar 10 which projects into the throttle bore in the opposite direction from the first supporting bar 9. Because the fuel injection valve 3 is offset in the direction of the second supporting bar 10, the length of the first supporting bar 9 is longer than that of the second supporting bar 10. The first supporting bar 9 is thicker in its vertical direction and longer in its horizontal direction than that of second supporting bar 10. This results in an increase of weight and an increase in intake resistance. To overcome the afore-mentioned disadvantages, a second embodiment of the present invention is shown in FIG. 5. Fuel injection valve 3 is supported by the first supporting bar 9, which contains the fuel supply passage 6, and by the second supporting bar 10, which contains the fuel return passage 7 and the electric wiring connector 18, which activates and controls the fuel injection valve 3. This results in reduced weight and reduced intake resistance over the design displayed in FIG. 2 because the second supporting bar 10 of FIG. 5 is equivalent in vertical thickness to the second supporting bar 10 of FIG. 2, but the FIG. 5 second supporting bar 10 is thinner in its horizontal dimension than the second supporting bar 10 of FIG. 2. The center line 13 of the fuel injection cone is parallel to the center line of the throttle bore 4, but offset in the direction of the downstream edge 2A of the throttle valve 2, so that the injected fuel reaches the downstream area of throttle valve 2.

Figure 6:
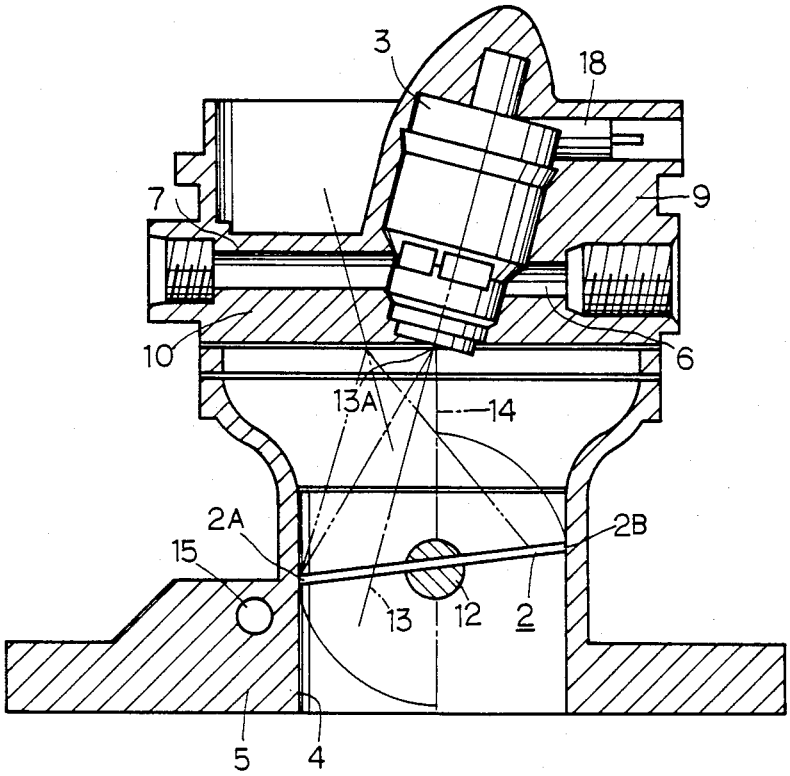
FIG. 6 is a cross-section view of another embodiment according to the present invention.

A third embodiment of the present invention is illustrated in FIG. 6. This embodiment differs from the embodiments shown in FIGS. 2 and 5 in that the center line 13 of the fuel injection valve 3 is inclined with reference to the center line 14 of the throttle bore 4. According to this embodiment, the horizontal thickness of the first supporting bar 9, which contains the wiring connector 18 and the fuel supply passage 6, is less than that of the larger supporting bars of FIGS. 2 and 5. This results in an overall decrease in weight, a larger intake passage and improved atomization of the injected fuel. In this third embodiment, the center-line 13 of the fuel injection valve 3 is inclined as shown in FIG. 6.

The present invention is not limited to the specific clockwise inclination, illustrated in FIG. 6, of the fuel injection center line 13 of the fuel injection valve 3 because it may be inclined in the other (counter-clockwise) direction. In this instance, the fuel injection angle is illustrated by the two-dot chain line shown in FIG. 6. As apparent from FIG. 6, the outer part of the downstream side of the fuel injection cone substantially corresponds to the downstream edge 2A of the throttle valve 2.

The downstream edge of the fuel injection cone may intersect the inner wall of the throttle bore 4 at the position of throttle valve 2. In this instance, a part of the fuel injected from the fuel injection valve 3 attaches to the inner wall of the throttle bore 4. However, this does not present any serious fuel distribution problems because any residual fuel which may adhere to the throttle bore 4 is located close enough to the downstream edge 2A of the throttle valve 3, that the higher velocity fuel-air mixture quickly compensates for the adherent residual fuel. Therefore, the amount of fuel adhering to the inner wall of the throttle bore 4 is very small.

Even though some amount of fuel may adhere to the inner wall of the throttle bore 4, that residual fuel can be promptly atomized.

In the above embodiments, the warm water passage 15 provided in the throttle body 5 and is used as a means for warming the injected fuel. However, other means such as a glow plug, PTC (Positive Temperature Coefficient) Element may be used instead of warm water.

Figure 7:
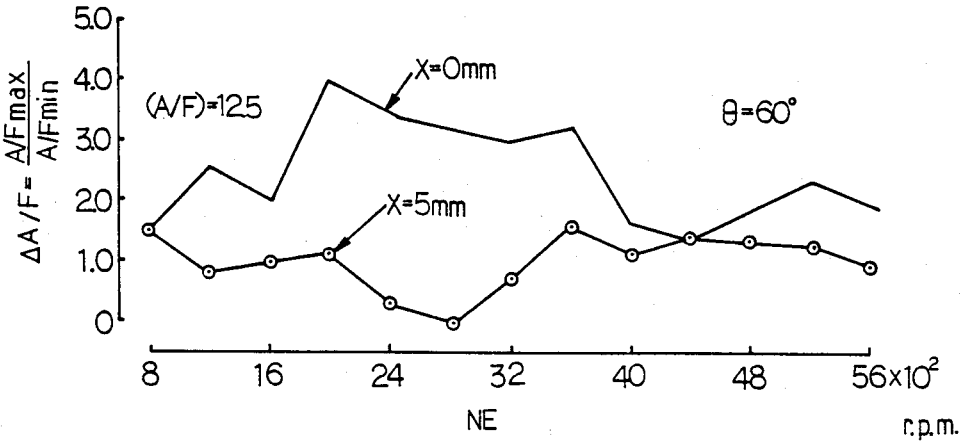
FIG. 7 is a fuel distribution graph comparing the distribution performances by conventional fuel injection devices against an embodiment in FIG. 2.
Figure 8:
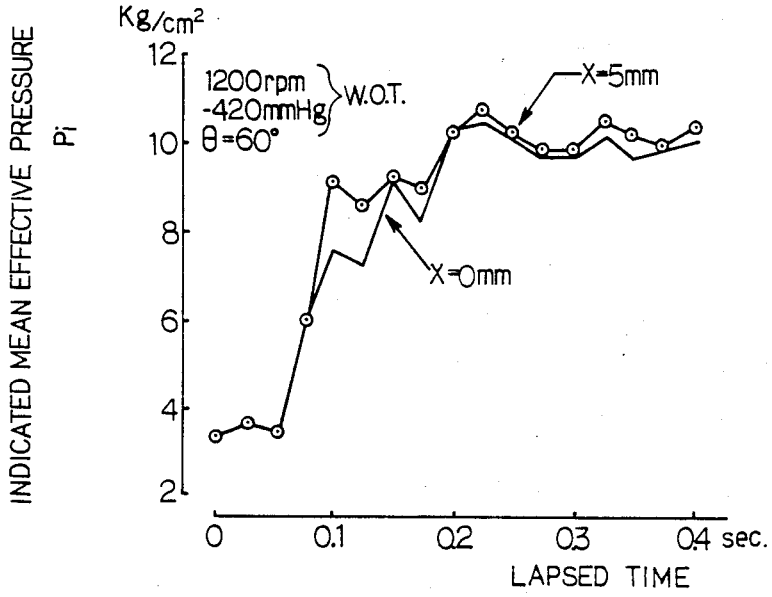
FIG. 8 is a transitional engine response graph comparing the engine response time of conventional fuel injection devices against that of the embodiment of FIG. 2.

The experimental data from use of the first embodiment of FIGS. 2, 3 and 4 is disclosed in FIGS. 7 and 8. The experimental conditions were as follows:

Mean air-fuel ratio: 12.5

Fuel injection angle: 60°

In FIG. 7, the ordinate axis corresponds to a ratio of the maximum to minimum air to fuel ratio and the abscissa represents the revolutions per minute (RPM) of the engine. The offset value X of the center line 13 of the fuel injection valve 3, from the center line 14 of throttle bore 4 was:

X=0—FIG. 1

X=5 mm—FIG. 2

Figure 1:
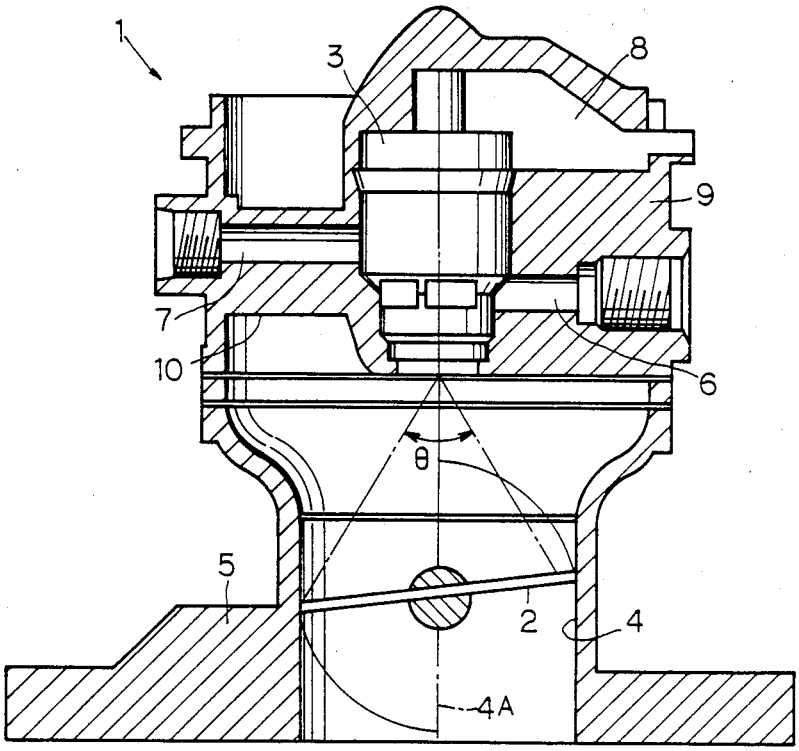
Fig. 1 (PRIOR ART)
FIG. 1 is a cross-sectional view showing a known fuel injection device.

As apparent from FIG. 7, the data from the device of FIG. 2 (X=5 mm) is generally lower than that of FIG. 1 (X=0). These results are interpreted as meaning that the fuel distribution performance from the embodiment in FIG. 2 is improved over that of the device of FIG. 1.

Referring next to FIG. 8, the engine transitional response is plotted. The ordinate axis represents the mean effective pressure of the engine and the abscissa represents the amount of time which elapses in order for the throttle valve to open completely when the intake manifold vacuum is −420 mmHg. The experimental conditions of FIG. 8 were as follows. The fuel injection angle $\theta$ of the fuel injection valve was 60° and the engine speed was 1200 r.p.m. (the engine was equipped with an air cleaner). As apparent from FIG. 8, the data from the embodiment of FIG. 2, with the offset value wherein X=5 mm, is superior to the data from the device of FIG. 1, where the fuel injection valve 3 was not offset.

While the present invention has been described in its preferred embodiment, it is to be understood that the invention is not limited thereto but may be otherwise embodied within the scope of the following claims.

What is claimed is:

1. A fuel injection apparatus for use in an internal, combustion engine, comprising:

a throttle body having a throttle bore therein;

a throttle valve means being rotatably responsive to an accelerator means, for controlling an amount of fuel-air mixture provided in said throttle bore, said throttle valve means having an upstream portion and a downstream portion, said upstream portion being located further upstream in the throttle bore with respect to the downstream portion upon opening of said throttle valve means; and a fuel injection valve mounted upstream of said throttle valve means for injecting fuel primarily toward the downstream portion of the throttle valve means, said fuel being injected primarily toward said downstream portion by said fuel injection valve having its center-line oriented toward the downstream portion of said throttle valve means, wherein the fuel injected by said fuel injection valve assumes the shape of a hollow cone, and a distribution of the fuel-air mixture supplied to each cylinder of an engine is improved.

2. The apparatus of claim 1, wherein said fuel injection valve is located offset from a center-line of said throttle bore.

3. The apparatus of claim 2, wherein the center-line of said fuel injection valve is parallel to the-center line of said throttle bore.

4. The apparatus of claim 3, wherein means for warming the fuel is located in said throttle body adjacent said downstream edge of said throttle valve.

5. The apparatus of claim 4, wherein the warming means comprises warm water from an engine radiator.

6. The apparatus of claim 3, wherein the distance between said center line of said throttle bore and said fuel injection valve is no more than 5 mm.

7. A fuel injection apparatus for use in an internal combustion engine, comprising:

a throttle body having a throttle bore therein;

a throttle valve means being rotatably responsive to an accelerator means for controlling an amount of fuel-air mixture injected into said throttle bore, said throttle valve means having an upstream portion and a downstream portion, said upstream portion being located further upstream in the throttle bore with respect to the downstream portion, upon opening of said throttle valve means; and a fuel injection valve mounted upstream of said throttle valve, for injecting fuel primarily toward the downstream portion of said throttle valve means, said fuel being injected primarily toward said downstream portion by said fuel injection valve being inclined toward the downstream portion of said throttle valve means, thereby providing for uniform distribution of a fuel-air mixture to each cylinder of the engine.

8. The apparatus of claim 6, wherein an outer periphery of a cone of injected fuel is directed toward a downstream edge of said throttle valve.

9. The apparatus of claim 8, wherein means for warming the fuel is located in said throttle body adjacent said downstream edge of said throttle valve.

10. The apparatus of claim 9, wherein the warming means comprises warm water from an engine radiator.

11. The apparatus of claim 1, wherein said throttle valve means is rotatable about a shaft.

12. The apparatus of claim 11, wherein said upstream portion and said downstream portion of the throttle valve means are distinguished from each other by an axis of the shaft about which the valve means is rotatable.

13. A fuel injection apparatus for use in an internal combustion engine, comprising:

a throttle body having a throttle bore therein;

a throttle valve means being rotatable about a shaft in response to an accelerator means, said throttle valve means controlling an amount of fuel-air mixture provided in said throttle bore, said throttle valve means having an upstream portion and a downstream portion, said upstream portion corresponding to a portion of the throttle valve means extending from an axis of said shaft and positioned upstream in said throttle bore with respect to said downstream portion of the throttle valve means upon opening of said throttle valve means, said downstream portion corresponding to a portion of the throttle valve means extending from an axis of said shaft and positioned downstream in said throttle bore with respect to said upstream portion of the throttle valve means, upon opening of said throttle valve means;

a fuel injection valve mounted upstream of said throttle valve means, said fuel injection valve injecting fuel primarily toward the downstream portion of the throttle valve means, said fuel being injected primarily toward said downstream portion by said fuel injection valve having its center-line oriented toward the downstream portion of said throttle valve means, wherein the fuel injected by said fuel injection valve assumes the shape of a hollow cone, thereby permitting uniform distribution of the fuel-air mixture to each cylinder of the engine.

14. The apparatus of claim 7, wherein said throttle valve is rotatable about a shaft.

15. The apparatus of claim 14, wherein said upstream portion and said downstream portion of the throttle valve means are distinguished from each other by an axis of the shaft about which the throttle valve means is rotatable.

* * * * *